US009604088B2

(12) United States Patent
Djang

(10) Patent No.: US 9,604,088 B2
(45) Date of Patent: Mar. 28, 2017

(54) RESISTANCE TRAINING DEVICES, SYSTEMS, AND METHODS

(71) Applicant: Douglas R. Djang, Federal Way, WA (US)

(72) Inventor: Douglas R. Djang, Federal Way, WA (US)

( * ) Notice: Subject to any disclaimer, the term of this patent is extended or adjusted under 35 U.S.C. 154(b) by 5 days.

(21) Appl. No.: 14/724,941

(22) Filed: May 29, 2015

(65) Prior Publication Data

US 2015/0343254 A1 Dec. 3, 2015

Related U.S. Application Data

(60) Provisional application No. 62/004,679, filed on May 29, 2014.

(51) Int. Cl.
*A63B 21/062* (2006.01)
*A63B 21/06* (2006.01)
(Continued)

(52) U.S. Cl.
CPC .... *A63B 21/0606* (2013.01); *A63B 21/00065* (2013.01); *A63B 21/062* (2013.01);
(Continued)

(58) Field of Classification Search
CPC ..... A63B 21/0601–21/0607; A63B 21/0615–21/0618; A63B 2208/03;
(Continued)

(56) References Cited

U.S. PATENT DOCUMENTS 3,861,675 A * 1/1975 Hopper ..... A63B 69/12 482/55
4,247,096 A * 1/1981 Schmitt ..... A63B 69/12 273/DIG. 30

(Continued)

OTHER PUBLICATIONS

[No Author Listed] Pinnacle Pulley System. RRace. Randy Reese Acquatic Conditioning Equipment. 2013, 4 pages. Retrieved from <http://www.rrace.net> on Oct. 27, 2015.

(Continued)

*Primary Examiner* — Stephen Crow
*Assistant Examiner* — Garrett Atkinson
(74) *Attorney, Agent, or Firm* — Nutter McClennen & Fish LLP

(57) ABSTRACT

Systems, devices, and methods for providing weighted resistance to swimmers are provided. The device can be portable and easy to use and set-up. In one exemplary embodiment, a resistance training device includes opposed pulley modules having a rope disposed between one or more pulleys of each of the two modules, a weighted component associated with one end of the rope, an attachment mechanism for attaching the device to a substantially fixed location, and a user interface for associating another end of the rope with a user. In use, the device can be fixed to a substantially fixed location, such as a dive block, and can provide resistance based, at least in part, on the amount of weight associated with the weighted component disposed in the water. Other systems, devices, and methods are also provided.

24 Claims, 11 Drawing Sheets

(51) Int. Cl.
*A63B 21/065* (2006.01)
*A63B 21/00* (2006.01)

(52) U.S. Cl.
CPC ..... *A63B 21/065* (2013.01); *A63B 21/154* (2013.01); *A63B 21/4009* (2015.10); *A63B 21/4025* (2015.10); *A63B 21/4043* (2015.10); *A63B 2208/03* (2013.01); *A63B 2209/10* (2013.01); *A63B 2210/50* (2013.01); *A63B 2225/60* (2013.01); *A63B 2244/20* (2013.01)

(58) Field of Classification Search
CPC ..... A63B 2244/09; A63B 69/10; A63B 69/12; A63B 69/14
USPC ..... 482/92, 98–102, 55, 56
See application file for complete search history.

(56) References Cited

U.S. PATENT DOCUMENTS 4,530,497 A * 7/1985 Moran ..... A63B 69/12 434/254
4,962,923 A * 10/1990 Earner ..... A63B 69/12 482/55
5,020,791 A * 6/1991 Phillips ..... A63B 69/12 114/253
5,072,934 A * 12/1991 Blanes ..... A63B 21/1627 482/904
5,236,404 A * 8/1993 MacLennan ..... A63B 69/12 434/254
5,244,393 A * 9/1993 Perry ..... A61H 1/0218 434/254
5,391,080 A * 2/1995 Bernacki ..... A63B 69/12 434/254
5,601,514 A * 2/1997 Horn ..... A63B 69/12 434/254
5,769,763 A * 6/1998 Lochbaum ..... A63B 21/0084 482/111
5,846,167 A * 12/1998 Liu ..... A63B 69/12 482/111
5,938,565 A * 8/1999 Bernacki ..... A63B 21/153 434/247
6,176,815 B1 * 1/2001 Riera ..... A63B 69/12 441/117
6,634,993 B1 * 10/2003 Morr ..... A63B 21/0552 434/254
6,705,974 B1 * 3/2004 Tardif ..... A63B 21/068 482/148
7,104,932 B1 * 9/2006 Brentlinger ..... A63B 69/12 434/254
7,175,569 B1 * 2/2007 Lan ..... A63B 21/4009 434/254
8,029,425 B2 * 10/2011 Bronston ..... A63B 21/02 482/123
8,388,502 B2 * 3/2013 Tedhams ..... A63B 69/12 482/54
2004/0197754 A1 10/2004 Coppelli
2006/0128531 A1 * 6/2006 Planke ..... A63B 7/02 482/39
2012/0094804 A1 * 4/2012 Bell ..... A63B 21/00069 482/8
2012/0277068 A1 * 11/2012 Zhou ..... A63B 69/182 482/71
2013/0267392 A1 * 10/2013 Miranda ..... A63B 21/06 482/102

OTHER PUBLICATIONS

[No Author Listed] Power Tower. Total Performance Inc. 2010, 26 pages. Retrieved from <http://www.totalperformance.org/power-tower> on Oct. 27, 2015.
[No Author Listed] RocketTower. Rocket Industries LLC. 2012, 11 pages. Retrieved from <http://www.rockettower.com> on Oct. 27, 2015.

* cited by examiner

RESISTANCE TRAINING DEVICES, SYSTEMS, AND METHODS

CROSS REFERENCE TO RELATED APPLICATION

The present disclosure claims priority to U.S. Provisional Application No. 62/004,679, entitled "Resistance Training Devices, Systems, and Methods," which was filed on May 29, 2014, and which is incorporated by reference herein in its entirety.

FIELD

The present disclosure relates to devices, systems, and methods for providing weighted resistance for training, and more particularly relates to weighted resistance training devices, systems, and methods for aquatic applications.

BACKGROUND

Swimmers use a variety of tools in training to help build strength, stamina, and speed. Some training tools use weights to help provide resistance to the swimmer. However, existing systems are cumbersome, ineffective, uncomfortable, and are often dangerous to the swimmer. They also have a tendency to impede a swimmer's strokes. Existing training devices often require that weights be attached to an outside structure that is remote from the pool, such as a ceiling, and the weights are typically located outside of the water. The angles formed by the various components of the tool and the swimmer lead to inefficiencies and other detriments that have a negative impact on the swimmer. For example, existing training tools often undesirably pull a swimmer out of the water.

Still further, existing systems are not very easy to transport and their set-ups are complicated and time intensive. For example, when using devices hooked up to the ceiling, a great deal of preparation is undertaken to hook-up all of the components to the ceiling and to the swimmer, and components hooked to the ceiling are not easily transportable. In some instances, swimmers and their coaches may merely jury-rig resistance-providing devices typically used for land training for use in a pool setting. The results are devices that do not perform well for many of the same reasons provided above. Still further, existing devices, whether built for use in swimming or not, are typically large and expensive.

Accordingly, there is a need for aquatic training devices and systems that are specifically tailored for use in swim training. The devices and systems should be easy to set-up, use, and transport, and they should provide efficient resistance to swimmers without negatively impacting their strokes. The devices should also be safe and comfortable to use.

SUMMARY

Devices and systems disclosed herein are generally portable, underwater weight-based, swim resistance training devices. While a variety of device or system configurations can be derived based on the disclosures provided for herein, as generally described the devices and systems can be configured to be fixed to a user, for instance by a waist belt, and the waist belt can be attached to a set of pulleys configured to lift a weighted component, such as a container (e.g., a bucket or bag) holding weights. The weights can allow a variable level of resistance, thereby giving a user control over the amount of resistance for his or her level of training required. The pulley system portion of the device can be easily attached to any number of components in and around a swimming pool area. Some non-limiting examples include a diving block or lane line. In some instances, a nylon webbing and Velcro® belt or strap can be used to attach the device to such components, making set-up, use, and breakdown simple and easy.

One unique feature of the devices and systems disclosed are that they use a stationary weight system that is in the water (although, as described herein, the "stationary" weight system does move up and down in the water, and thus stationary does not mean that the weight system is immobile throughout its use). Other training systems that use weights generally require that the weights be attached to an outside structure, such as a ceiling, and/or have weights located outside of the water. The present devices and systems allow for a more fluid and appropriate workout that does not impede a swimmer's stroke, due in part to the fact that the resistance comes from below the water. Additionally, because the present devices and systems allow for the resistance to be provided in the water, a swimmer is not pulled out of the water by the training system and the angles between components connecting the swimmer to the training device are not poor or otherwise inefficient, thus providing more efficiency. The present devices and systems also allow for sports-specific strengths, such as swimming in at least one of the illustrated embodiments, to be developed. Still further, the present devices and systems are configured in a manner that allow them to be easily transported to and from a pool by a swimmer, coach, or other person, and to subsequently be easily set-up for use in the pool.

The devices and systems can be used by almost any person, regardless of age, size, and level of experience. By way of non-limiting examples, the devices and systems provided for in the present disclosure can be used by elite athletes, recreational swimmers, tri-athletes, water polo players, kids in swim lessons or training competitively, and individuals interested in general health and fitness training, including but not limited to members of the geriatric population and individuals rehabilitating from injuries. The present devices and systems can also be used by animals, for instance dogs receiving aquatic training. The devices and systems are exceptional training devices for anyone with limited time who requires an efficient workout in a short amount of time. Further, the devices and systems can allow a user to add weights for resistance during a workout so that he or she can increase the fat burning process, maintain good cardiovascular health, and significantly increase muscle mass, power, endurance, and strength, among other features.

Any number of known swim training techniques can be enhanced by use of the present device, and further, new training techniques can result from the devices and systems provided for herein. Some non-limiting examples of swim training techniques with which the devices and systems can be used include sprint training, distance work, etc. Further, any type of swimming stroke can be performed by a user while using the devices and systems, including all four competitive strokes—freestyle, backstroke, butterfly, and breaststroke. As provided for herein, the more weights applied to the device, the higher the level of resistance that is provided. Accordingly, the faster or harder a user swims, the more resistance the user will receive.

Along with the devices and systems disclosed, a user can vary workouts and training in a variety of manners. By way of non-limiting examples, a user can utilize a pull buoy, hand paddles, fins, kickboards, etc. in conjunction with the devices and systems. The devices and systems are designed to provide a swimmer with a varying intensity of training workouts. Workouts can be changed from light to progressively more resistance in hard training sessions to lighter resistance during taper.

Further, the compact nature of the devices and systems provided allow swimmers and coaches a very portable resistance training system. Individuals and teams can easily travel with the device or system, thus making travel training just as effective as training at a user's home pool. Additionally, the devices and systems allow for more efficient and complete workouts in less pool time, and can reduce potential injuries from overuse/training.

In one exemplary embodiment, a resistance training device includes a rope, a pulley system, a weight management system, and an attachment system. The rope has one end configured to be coupled to a user, and at least a portion of the rope passes through the pulley system. The weight management system is coupled to the pulley system and is configured to provide resistance to a user that is coupled to the one end of the rope. The attachment system is coupled to the pulley system and is configured to attach the pulley system to a substantially fixed location.

In some embodiments, the pulley system can include a first pulley module having one or more pulleys and a second pulley module also having one or more pulleys. The second pulley module can be coupled to the weight management system, and the rope can extend between the one or more pulleys of the first pulley module and the one or more pulleys of the second pulley module. The rope can extend from the first pulley module, away from the second pulley module, to be coupled to a user.

The weight management system can be configured to be disposed under water in use. It can also be configured to allow weight to be adjusted to change the resistance provided by the device. For example, it can be configured to receive additional weights. The rope can be configured to extend away from the pulley system as a user moves away from the weight management system. In some embodiments, the weight management system can include a transport bag that is configured to receive the pulley system, the rope, and the attachment mechanism to provide for portability of the entire resistance training device.

In another exemplary embodiment, a resistance training device includes an attachment mechanism for attaching the device to a substantially fixed location, a plurality of pulleys having a rope associated therewith, and a weight component associated with at least one pulley of the plurality of pulleys to provide a resistance to an end of a rope disposed on the other side of the plurality of pulleys.

The plurality of pulleys can include a first pulley that is located higher than a second pulley, with the second pulley being associated with the weighted component. In some embodiments, the first pulley can be part of a first set of pulleys and the second pulley can be part of a second set of pulleys. The first set of pulleys can be located closer to the attachment mechanism than the second set of pulleys is located, and the second set of pulleys can be located closer to the weight component than the first set of pulleys.

The weighted component can be configured to be disposed under water in use. It can also be configured to allow weight to be adjusted to change the resistance provided by the device. For example, it can be configured to receive additional weights. The rope can be configured to extend away from the plurality of pulleys as a user moves away from the weight component. In some embodiments, the weight component includes a transport bag that is configured to receive the attachment mechanism and the plurality of pulleys having a rope associated therewith to provide for portability of the entire resistance training device.

In one exemplary embodiment of a method for providing resistance while swimming, the method includes attaching a resistance training device to a substantially sturdy point proximate to a swimming pool such that a weighted housing of the device is disposed under water, and attaching the resistance training device to a user such that as the user swims away from the substantially sturdy point, the weighted housing moves towards a surface of the water.

The method can further include storing all other components of the resistance device in the weighted component to transport the device. The resistance training device can include a plurality of pulleys and a rope disposed between the pulleys. The rope can be attached to the user such that as the user swims away from the substantially sturdy point, the rope travels with respect to the pulleys. The method can further include adjusting a weight in the weighted component to change the amount of resistance provided to the user. In some embodiments, the substantially sturdy point can be a dive block.

BRIEF DESCRIPTION OF THE DRAWINGS

This disclosure will be more fully understood from the following detailed description taken in conjunction with the accompanying drawings, in which.

DETAILED DESCRIPTION

Figure 1:
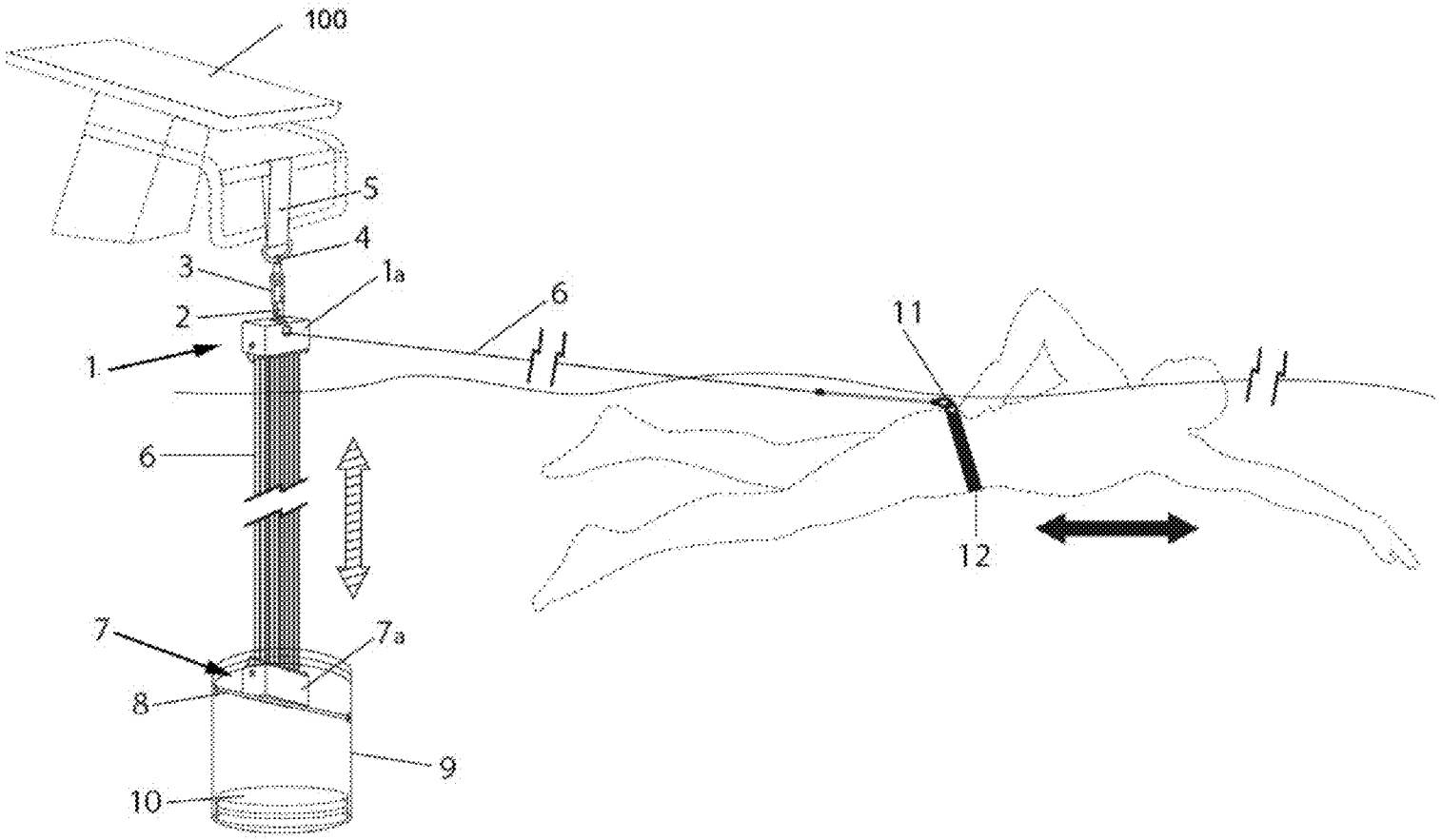
FIG. 1 is a schematic perspective view of one exemplary embodiment of a resistance training system that includes a pulley system, a weight management system, and a user interfacing system.

Certain exemplary embodiments are illustrated and described to provide an overall understanding of the principles of the structure, function, manufacture, and use of the devices, systems, and methods disclosed herein. One or more examples of these embodiments are illustrated in the accompanying drawings. To the extent certain features are illustrated but are not described or fully described, a person having ordinary skill in the art will be able to discern the uses of the systems and devices for provided by the illustrations alone. Further, those skilled in the art will understand that the devices, systems, and methods specifically described herein and illustrated in the accompanying drawings are non-limiting exemplary embodiments and that the scope of the present invention will be defined by any claims associated therewith. The features illustrated or described in connection with one exemplary embodiment may be combined with the features of other embodiments. Such modifications and variations are intended to be included within the scope of the present invention. As a result, to the extent one exemplary embodiment of a resistance training device or system includes a particular feature, a person skilled in the art would be able to incorporate that feature into other devices and systems, whether such devices or systems are provided for herein or are otherwise known to those skilled in the art.

In the present disclosure, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Sizes and shapes of the resistance training devices and systems, and the components associated therewith, can depend at least in part on the anatomy of the user, the length and depth of the swimming pool in which the devices/systems are used, and the training methods with which the devices and systems will be used. To the extent features are described herein as being a "first feature" or a "second feature," such numerical ordering is generally arbitrary, and thus such numbering can be interchangeable.

The figures provided herein are not necessarily to scale. Further, while in some embodiments movement of one component is described with respect to another, a person skilled in the art will recognize that other movements are possible.

As provided for in the drawings in the present application, the devices and systems can include: (1) a pulley resistance system, which can include the portions associated with the pulleys; (2) an attachment system, which can include ways by which the resistance training device can be coupled to a substantially fixed location; (3) a weight carriage or management system, sometimes referred to as a weighted component, which can be used to adjust an amount of weight associated with the device, and imparts an amount of resistance the device provides to a user; and (4) a user interfacing system that can include a resistance belt and a suspension system, i.e., a rope, to attach to the user and to associate the user with device, e.g., by way of the pulley resistance system. In one exemplary embodiment, the device is referred to as the ProteusONE and is a weight resistance training system for aquatic applications.

The device can be attached to a substantially sturdy or otherwise substantially fixed point near the surface of the water. For example, as shown in FIG. 1, a diving block 100, or in alternative embodiments a component such as a lane divider. A person skilled in the art will recognize other locations to which the disclosed devices and systems can be fixed without departing from the spirit of the present disclosure. An attachment strap 5 can be part of the attachment system, illustrated at least in FIGS. 2-7, and can be used to removably couple the device to the diving block 100. The strap 5 can be adjustable to allow the portions connected thereto, as shown the pulley system, e.g., an upper pulley module 1 and portions associated therewith and described in further detail below, to be lowered or raised to a desired position with respect to water and/or the diving block 100. Other portions of the attachment system can include a position pivot component, as shown a D-ring position pivot component 4, an attachment clip 3, and a position clip 2. These components can have a variety of features, but in some instances the position pivot component 4 can be configured to pivot to allow the components of the system disposed below it to not be rigidly associated with the diving block 100. The attachment clip 3 and position clip 2 can be used to help secure the attachment of the upper pulley module 1 to the attachment strap 5, and can allow for removable association of the same so that various pulley systems and/or various weight management systems can be used in conjunction with the attachment strap 5.

Figure 2:
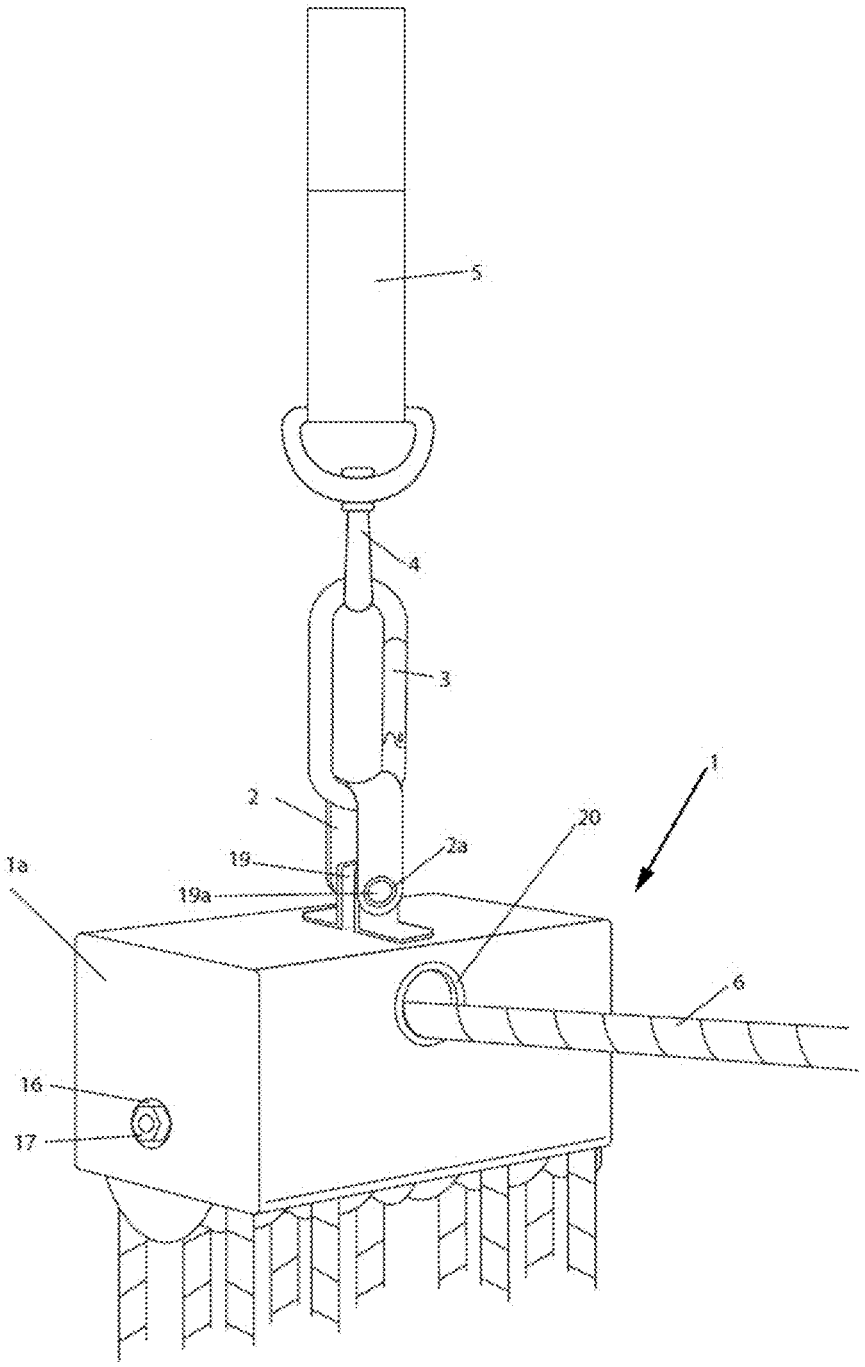
FIG. 2 is a perspective view of a portion of the pulley system of FIG. 1.

The sizes and materials used to form each of the attachment strap 5, position pivot component 4, attachment clip 3, and position clip 2 are known to those skilled in the art based on the descriptions and illustrations provided for herein. By way of non-limiting example, the attachment strap can be formed from a nylon webbing and/or a Velcro® belt or strap. As shown in FIG. 2, these features can be configured to be associated with a top portion of a housing 1*a* of the upper pulley module 1, as described in further below, and the pulley module 1 can include various features to assist in that process, such as an extension 19 having a grommet 19*a* to which the position clip 2 can be removably attached. As also shown in FIG. 2, a rope grommet 20 can be provided in the upper housing 1*a* to allow the rope 6 to extend therefrom, towards a user.

Figure 3:
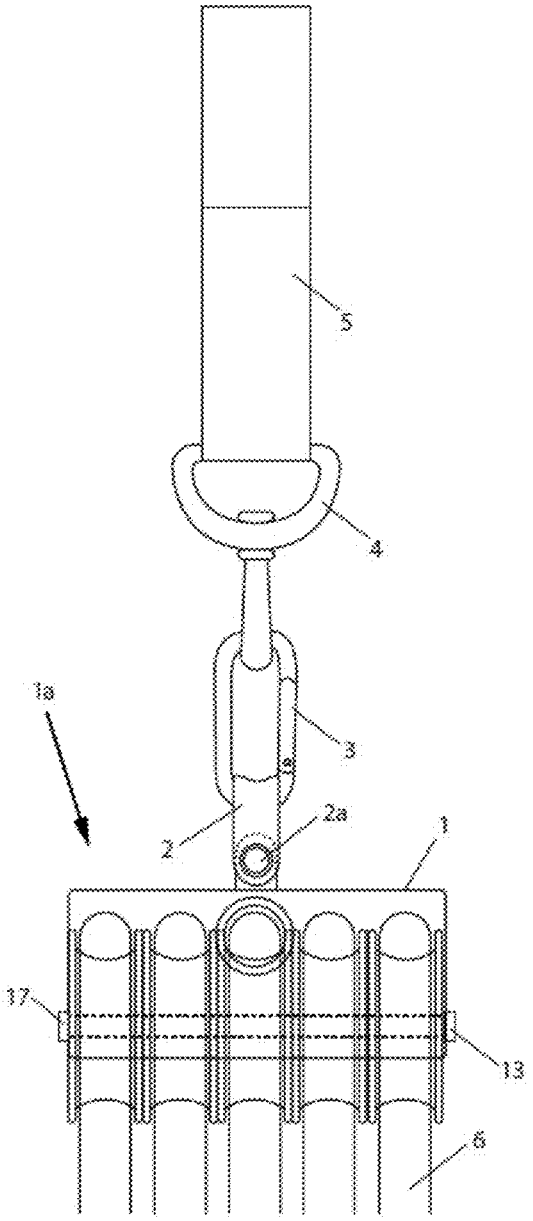
FIG. 3 is a partially transparent side view of the pulley system of FIG. 2.
Figure 4:
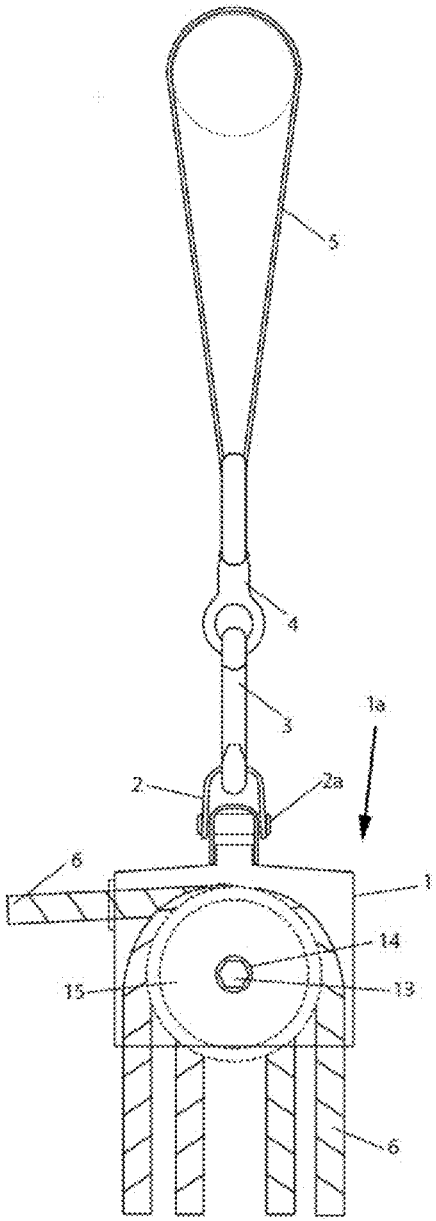
FIG. 4 is a partially transparent front view of the pulley system of FIG. 2.
Figure 5:
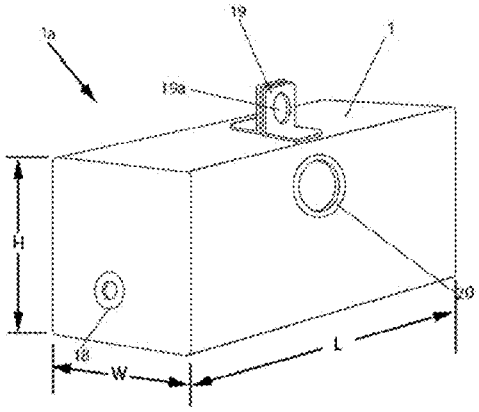
FIG. 5 is a perspective view of a top pulley encasement portion of the pulley system of FIG. 2.
Figure 6:
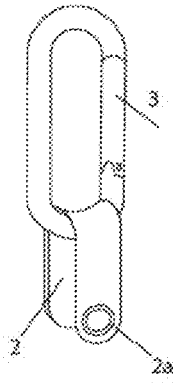
FIG. 6 is a side view of a portion of an attachment system of the pulley system of FIG. 2, the portion including an attachment clip and a position clip to allow the top pulley encasement portion of FIG. 5 to be coupled to a sturdy location.
Figure 7:
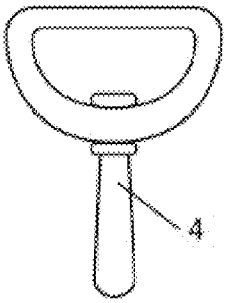
FIG. 7 is a side view of a portion of an attachment system of the pulley system of FIG. 2, the portion including a position pivot component to allow pivoting of the top pulley encasement portion of FIG. 5.
Figure 8:
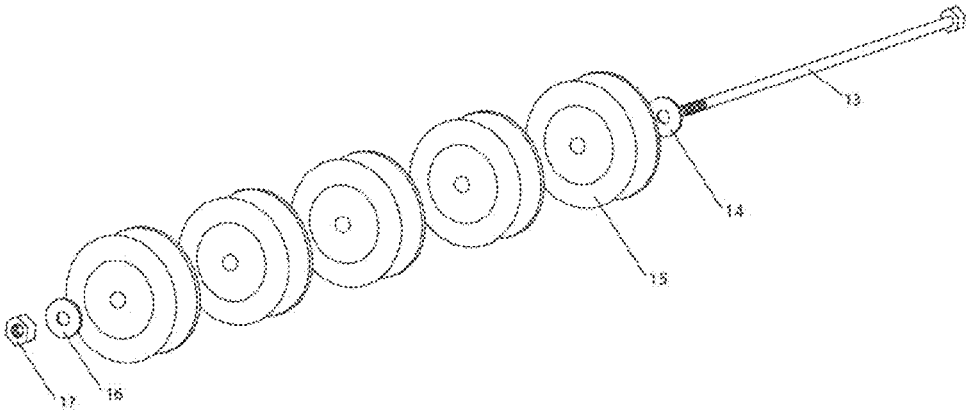
FIG. 8 is an exploded perspective view of a plurality of pulleys, an axle, and other components related to the same of the top pulley encasement portion of FIG. 5.

In some embodiments, the pulley system can include an upper pulley module 1 having an upper housing or encasement 1*a* and a plurality of pulleys 15 disposed therein. As shown in FIGS. 3 and 8, there are five pulleys 15, although in other embodiments there can be less than five, such as three, or more than five, such as seven. In some instances even a single pulley can be used. A rod, pin, or axle 13 can extend through the housing 1*a* and the pulleys 15 can be associated therewith, for instance disposed on the axle 13 as shown. While any number of techniques for coupling pulleys to an axle and an axle to a housing can be used, in the illustrated embodiment washers 14 and 16 and nuts 17 are disposed at one or both ends of the axle 13 to secure the axle 13 to the housing 1, for instance at a grommet 18 of the housing 1.

Figure 9:
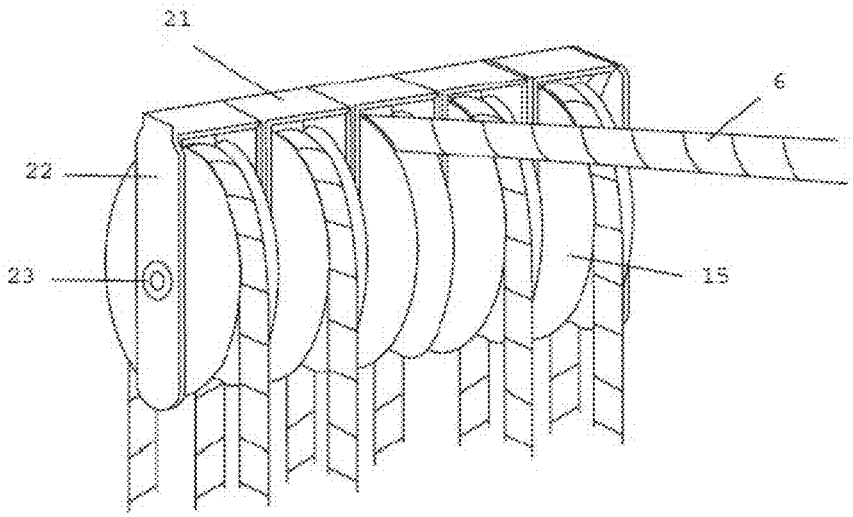
FIG. 9 is a perspective view of the plurality of pulleys of FIG. 8 associated with a frame, the frame being able to be used in conjunction with the top pulley encasement portion of FIG. 5, amongst other pulley module configurations.
Figure 10:
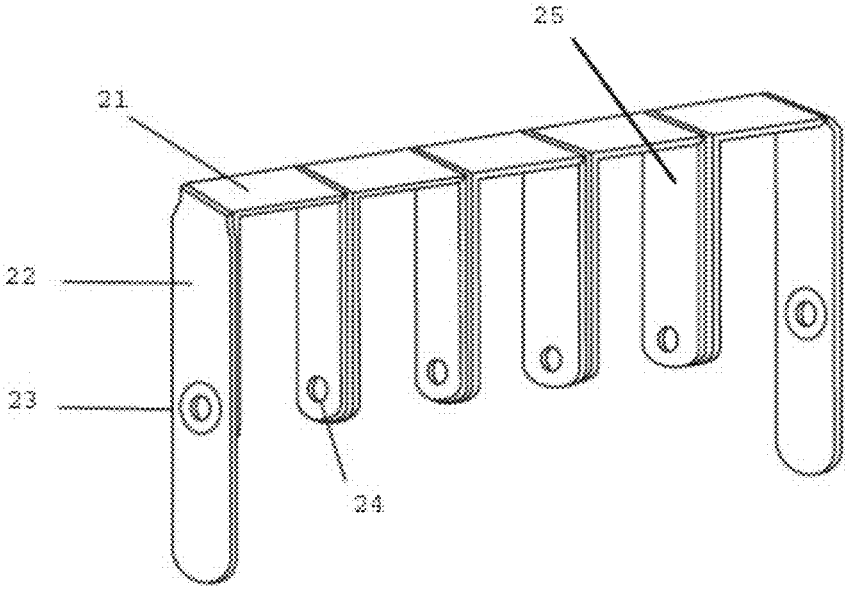
FIG. 10 is a perspective view of the frame of FIG. 9.

The pulleys 15 can be associated with the housing 1*a* by way of a frame 21, shown in FIGS. 9 and 10. As shown, each pulley 15 can be disposed in a compartment of the frame 21 defined by an end bar 22 and a middle bar 25 or two middle bars 25. Each of the two opposed end bars 22 can have a grommet 23 formed therein for receiving ends of the axle 13 and for use in conjunction with the grommet 18 of the housing 1*a*. Additional grommets 24 can be disposed in each of the middle bars 25 for also receiving the axle 13.

In some embodiments, the pulley system can also include a lower pulley module 7 having a lower housing or encasement 7*a*, which as shown is at a location that is lower than the upper module 1 in use. The lower pulley module 7 can have a similar configuration as the upper pulley module 1, and thus as shown it can include a plurality of pulleys. Further, the pulleys of the lower pulley module 7 can be associated therewith in a manner similar to the pulleys 15 of the upper pulley module 1, or by using other techniques and configurations known to those skilled in the art. The pulleys used in the lower pulley module 7 can be similar to the pulleys 15 used in the upper pulley module 1, although they do not have to be. A person skilled in the art will recognize how to mix and match various pulley and rope sizes to achieve desired resistance ranges.

The size and shape of the modules 1, 7 can depend, at least in part, on the size and shape of the other components associated therewith, the size of the pool in which the system will be used, and the desired use of the device or system. In the illustrated embodiment the housings 1*a*, 7*a* of the modules 1, 7, respectively, are substantially rectangular, although other shapes and configurations are possible. In some embodiments, a length L of the housings 1*a*, 7*a* can be approximately in the range of about 3 inches to about 24 inches, a width W of the housings 1*a*, 7*a* can be approximately in the range of about 1 inch to about 24 inches, and a height H of the housings 1, 7 can be approximately in the range of about 1 inch to about 24 inches, and in one exemplary embodiment the housings 1*a*, 7*a* each have a length L of about 7 inches, a width W of about 3 inches, and a height H of about 4 inches. The dimensions of the housings 1*a*, 7*a* can be, but do not have to be, similar. In embodiments in which no housings are provided, such as those described below with respect to FIGS. 11-13, the measurements of the modules can be similar to those described above for the housings 1*a*, 7*a*, and thus a length L' of the modules can be approximately in the range of about 3 inches to about 24 inches, a width W' of the modules can be approximately in the range of about 1 inch to about 24 inches, and a height H' of the modules can be approximately in the range of about 1 inch to about 24 inches.

Figure 11:
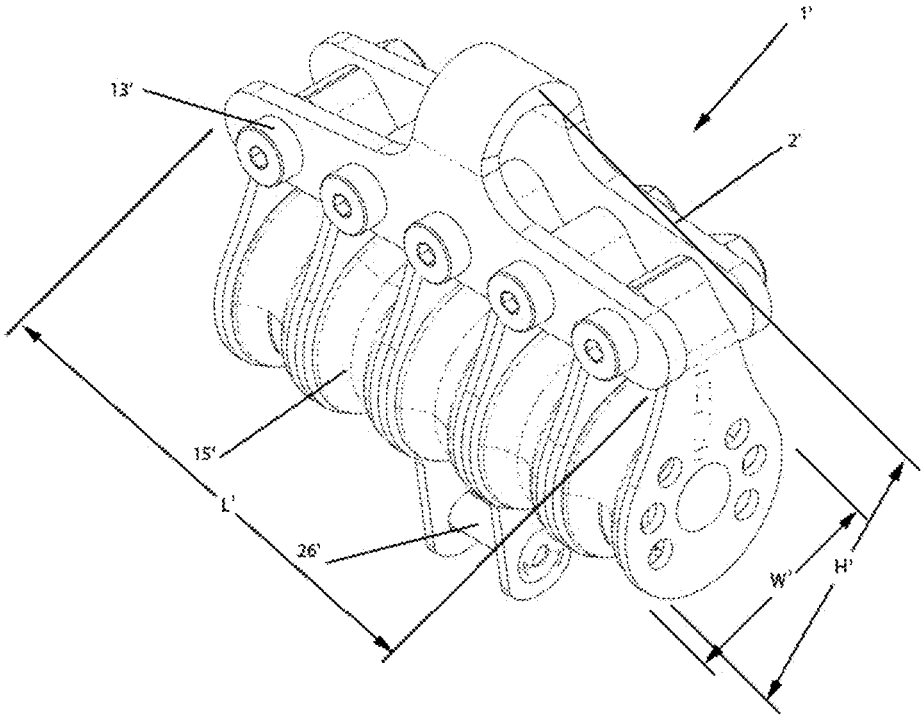
FIG. 11 is a perspective view of a top pulley module for an alternative embodiment of a pulley system.
Figure 12:
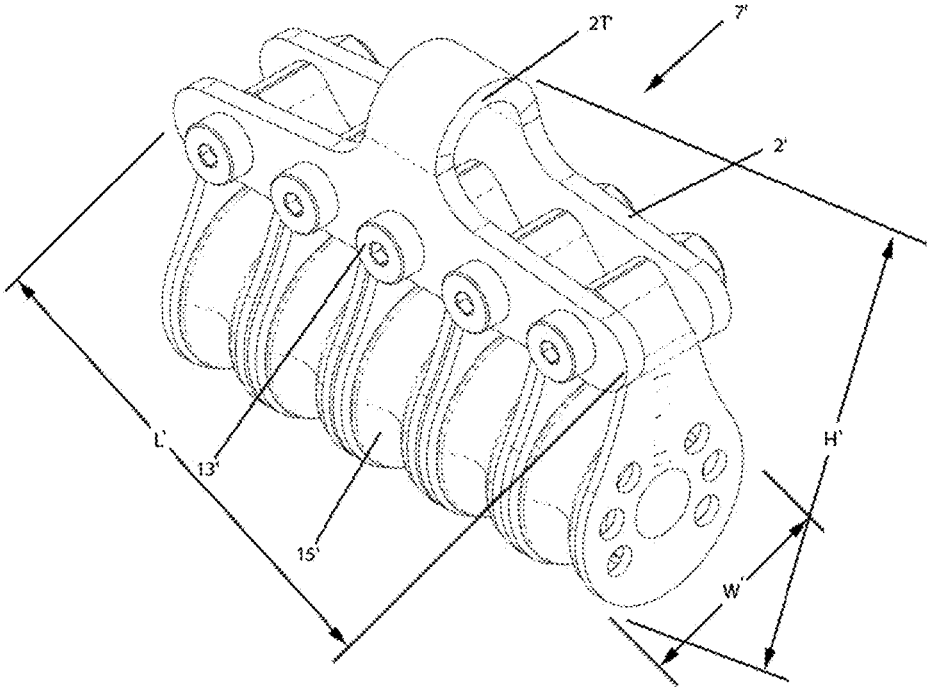
FIG. 12 is a perspective view of a bottom pulley module for the pulley system of FIG. 11.
Figure 13:
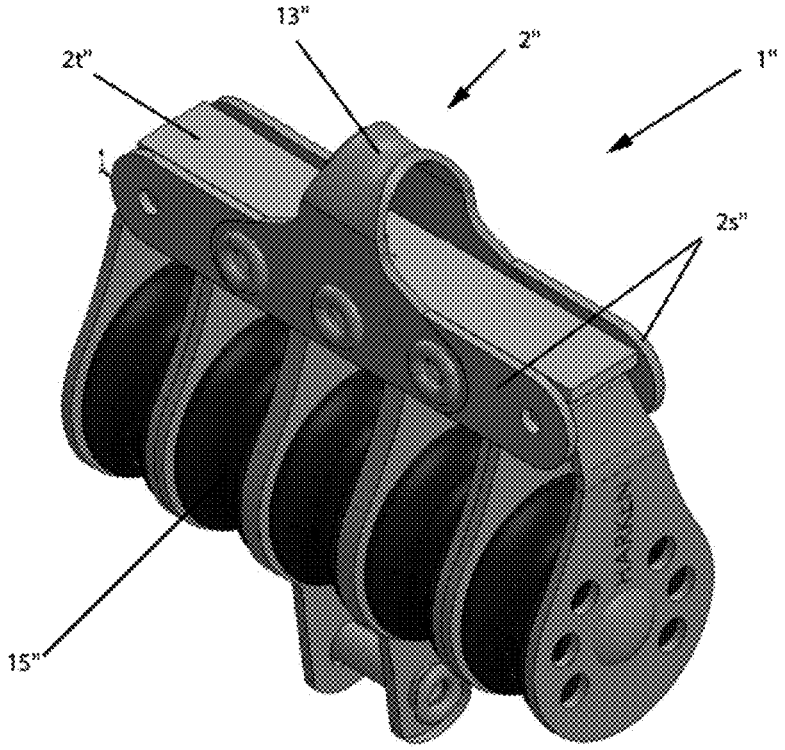
FIG. 13 is a perspective view of an alternative top pulley module.

Turning to embodiments of pulley modules that do not include housings or encasements, FIGS. 11-13 provide pulley systems, or portions thereof, having modules with no housings akin to the housings 1*a*, 7*a*. As shown in FIG. 11, a top pulley module 1' includes a plurality of pulleys 15' (e.g., five), with each pulley being independently mounted to a retention clip or bracket 2'. The bracket 2' includes a top portion configured to receive an attachment clip, such as the attachment clip 3 (e.g., as shown in FIGS. 1-4 and 6), so that the top pulley module 1' can be coupled to an attachment strap, such as the attachment strap 5 (e.g., as shown in FIGS. 1-4). A plurality of crosspins 13', one for each pulley 15', is disposed between opposed sides of the retention clip 2' to retain the pulleys with respect to the clip. A becket 26' can extend distally below the pulleys 15', from which a separate attachment component, such as a rope, can extend to couple the top pulley module 1' to a bottom pulley module 7', which is provided for in FIG. 12. Unlike the pulley module of FIGS. 9 and 10, the pulleys are not disposed within a housing or encasement. By eliminating the housing or encasement, it can be easier for a user to repair, replace, and/or add and subtract pulleys. It also reduces the weight of the module. In some instances, however, it may be preferred to include a housing or encasement to protect the pulleys. Further, the individual mount of the pulleys, as opposed to mounting them all via an axle as provided for in the top mounting module 1, provides for additional flexibility and easier repairs of the system. Still further, the configuration of FIGS. 11-13 allow for custom mounting brackets to be used in conjunction with the pulleys 15', depending, at least in part, on the designs of the other components of the device, the desired resistance, and the type of desired use of the device.

The bottom pulley module 7' of FIG. 12 is similar in nature to the top pulley module 1', although it does not include a distally extending becket. A top portion 2T' of the retention clip or bracket 2' can receive the attachment component extending from the becket 26' of the top pulley module 1' to couple the two modules together. Similar to the top pulley module 1', the lower pulley module 7' includes a plurality of pulleys 15' and crosspins 13' for coupling the pulleys 15' to the bracket 2'.

Although the illustrated embodiments of the modules 1', 7' show each pulley 15' being individually mounted, a person skilled in the art will recognize a variety of other ways by which the pulleys can be associated with the clip, including using an axle or other components known to those skilled in the art. Further, a variety of other configurations are also possible. By way of non-limiting example, FIG. 13 illustrates an alternative embodiment of a top pulley module 1" in which a retention clip or bracket 2" includes a plurality of plates, as shown two side plates 2*s*" and a third top plate 2*t*", as well as a flexible mounting piece 13" that connects the two side brackets 2*s*". The pulleys 15" can be associated with the bracket 2" using any techniques known to those skilled in the art, including by individually mounting them through respective holes in the side plates 2*s*", or by coupling them to the top plate 2*t*". A person skilled in the art will recognize a variety of different configurations and sizes that can be used to form pulley modules, depending, at least in part, on the size and shape of the other components with which it is being used, the desired resistance to impart on a user, and the size of the pool with which the device is configured to be used.

Figure 14A:
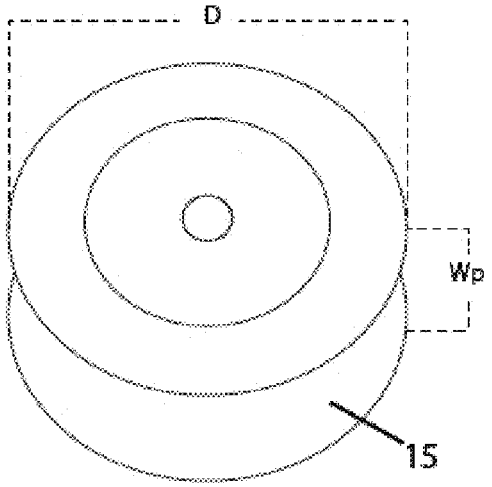
FIG. 14A is a perspective view of one pulley of the plurality of pulleys of FIG. 8.
Figure 14B:
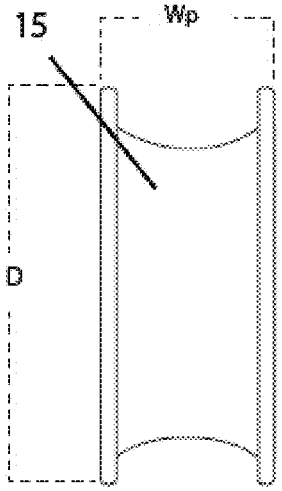
FIG. 14B is a side view of the pulley of FIG. 14A.
Figure 14C:
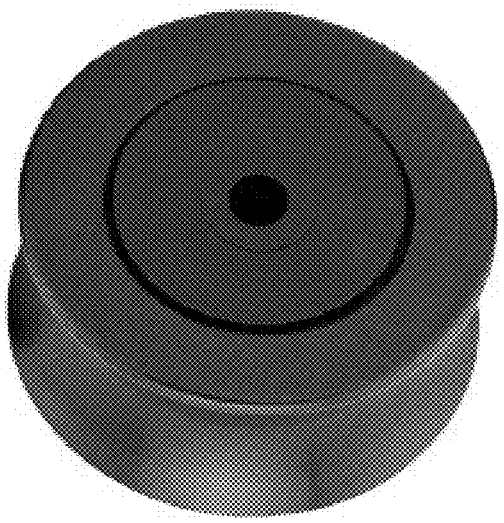
FIG. 14C is a shaded perspective view of the pulley of FIG. 14A.

The pulley system provided for herein can include any number of pulleys, as discussed above. Further, the pulleys can also have a variety of shapes and sizes, an example of which is provided for in FIGS. 14A-14C. The number, size, and shape of the pulleys can depend, at least in part, on the size and shape of the other components of the device, the depth of the pool in which they pulleys are used, and the type of training being performed. In some exemplary embodiments each pulley can have a diameter D in the range of about 0.5 inches to about 8 inches and a width $W_p$ in the range of about 0.1 inches to about 5 inches, and in one exemplary embodiment each pulley can have a diameter D of about 2 inches and a width $W_p$ of about 0.875 inches, with three pulleys being used for a pool having a depth of about 12 feet and five pulleys being used for a pool having a depth of about 9 feet. In some embodiments, the pulleys themselves can be enclosed in a container, such as a housing made of any number of materials, including but not limited to a polymer or plastic material. The material can be configured for extended and long-term use in water. Likewise, embodiments that use a bracket or clip instead of a housing or encasement can include brackets made of any number of materials, including but not limited to a polymer or plastic material, with the material typically being configured for extended and long-term use in water. The pulleys and components associated therewith, including but not limited to the axle, frame, washers, and nuts, can likewise be made from a variety of materials, including various metals, polymers, and plastics, with each component being made from the same or different materials.

The lower pulley module can be associated with the weight management system, which can include a weight bucket or housing 9 and one or more weights 10. A support bar 8 can be provided in the bucket 9 to maintain a location of the lower pulley module with respect to the bucket 9, although any number of other techniques known for coupling two components together can also be used. In the illustrated embodiment the weights 10 are approximately disc-shaped, and the bucket 9 in which they are disposed is substantially cylindrical, however, a person skilled in the art will recognize any number of shapes, sizes, and configurations that can be used to provide a weight management system without departing from the spirit of the present disclosure.

The size, shape, configuration, and weight of the weight management system can depend, at least in part, on the sizes, shapes and configurations of the other components of the device or system, the amount of resistance desired, the size of the pool in which the device or system is used, and the desired use of the device or system. In some exemplary embodiments, the weight bucket 9 can have a diameter in the range of about 5 inches to about 60 inches, and a depth in the range of about 10 inches to about 60 inches, and in one exemplary embodiment the bucket 9 has a diameter of about 16 inches and a depth of about 23 inches.

In some embodiments, features to help maintain the location of weights can be incorporated with or otherwise associated with the weight bucket 9. The types of features can depend, at least in part, on the size, shape, and configurations of the weights that will be used with the bucket 9 and of the bucket 9 itself, as well as the type of training with which the device will be used. One non-limiting example of such a feature can include a pole approximately centrally disposed in the bucket 9, extending from a base of the bucket 9 and towards an open end. The pole can be configured to receive weights 10 having a center hole formed therein such that the pole extends through the center hole of the weights 10 and the weights 10 are prevented from moving by any significant amount during use of the device. Other such features can include straps or other securing mechanisms capable of maintaining a location of weights placed in the weight bucket 9. Additionally, features known to those skilled in the art in view of the present disclosures that allow for weight to be easily added and removed from the weight management system can be incorporated into the weight management system without much difficulty.

Figure 15:
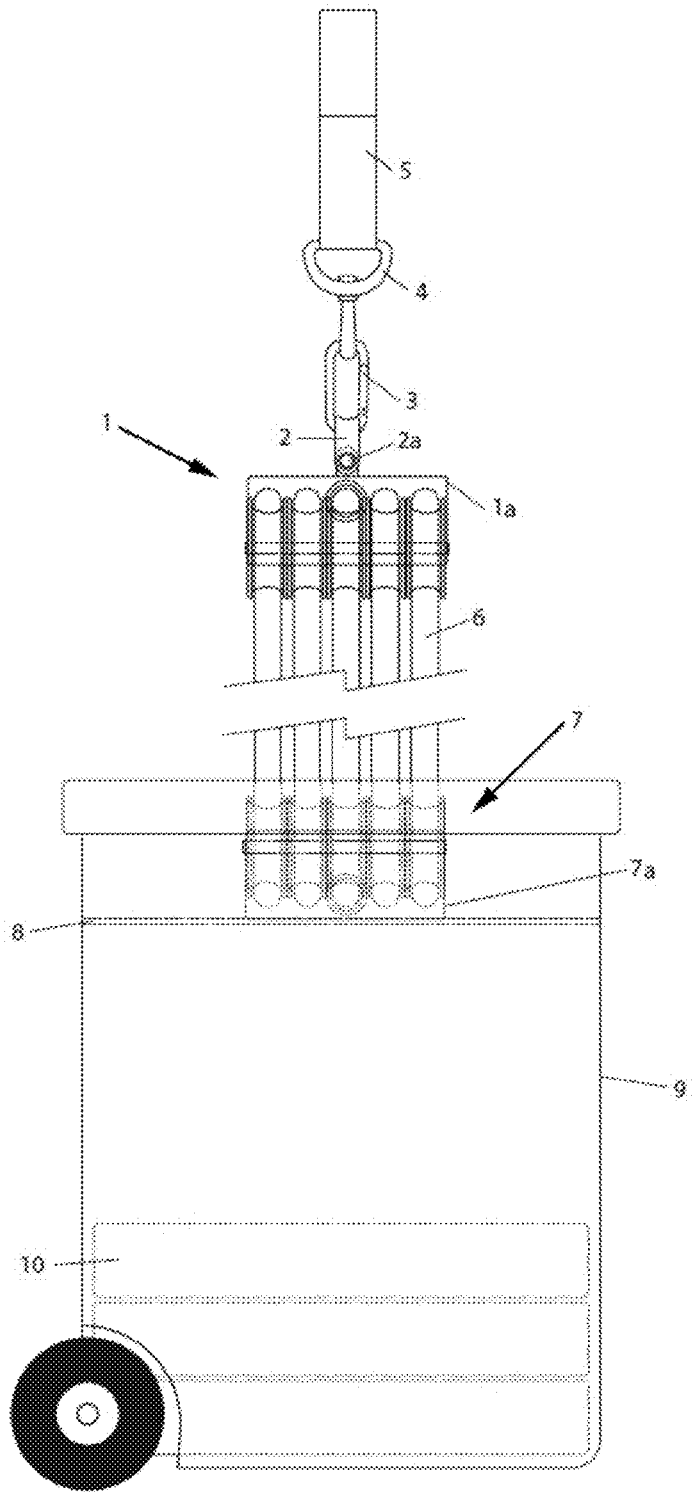
FIG. 15 is the pulley system and the weight management system of FIG. 1.

Further, the bucket or housing 9 can be configured to store the other components of the device or system, including the upper and lower pulley modules 1, 7, the rope 6, the attachment strap 5, the belt 12, and any other components described herein or which can be included as part of the device or system in view of the present disclosure and knowledge of those having skill in the art. In some embodiments, such as the bucket 9 of FIG. 15, one or more transportability features can be incorporated as part of the bucket. By way of non-limiting example, wheels can be provided at a bottom portion of the bucket 9 to help the portability of the device or system. By way of further non-limiting example, one or more handles (not illustrated) can be provided, such as on the bucket 9, exposable from the bucket 9, and/or attachable to the bucket 9. For instance, a handle disposed near a top portion of the bucket 9 and that moves up and down in a telescoping fashion can be incorporated to assist in transportability of the device or system.

Figure 16:
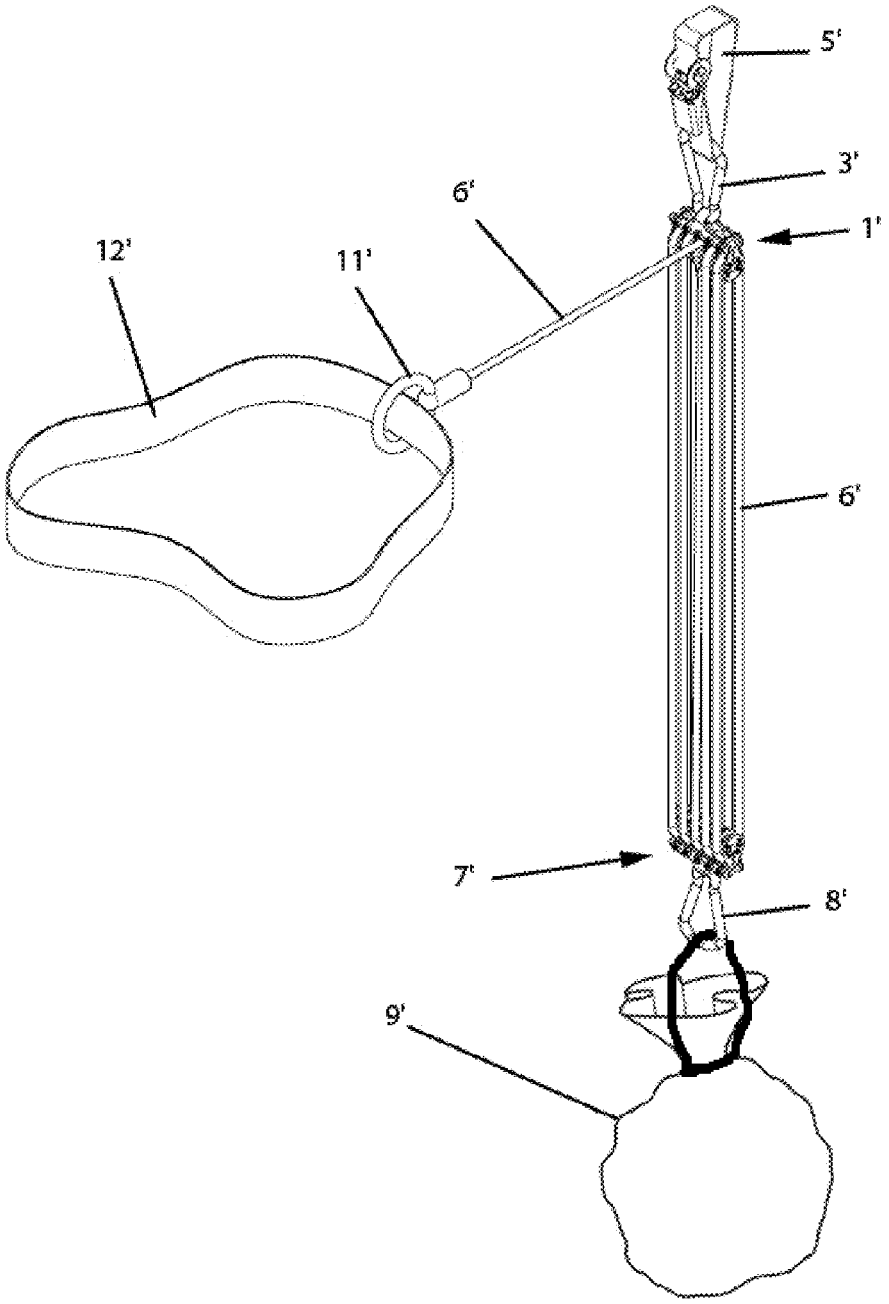
FIG. 16 is an isometric view of another exemplary embodiment of a resistance training system that includes a pulley system and a user interfacing system, the pulley system including the pulley modules of FIGS. 11 and 12.

In other embodiments, such as the embodiment illustrated in FIG. 16, a bag 9' can be used as the main weight receptacle for the weight management system, the bag 9' being connected to the attachment clip 8' by way of a rope or component capable of connecting two components of that nature together. Notably, the bag 9' illustrated in FIG. 16 is merely a schematic illustration of a bag and a person having ordinary skill in the art would understand may different bag configurations that can be used in conjunction with the present disclosure, including bags having specific characteristics that make them useful to hold weights and/or components of the device. Likewise, bags can also be specifically designed to allow for easy weight changes and transportability for use in conjunction with the present disclosures. As shown, the system can include an attachment strap 5' coupled to an attachment clip 3', which in turn is coupled to the upper pulley module V. One or more ropes 6' extend between the upper and lower pulley modules 1', 7', which themselves can be coupled together by way of an attachment component (not visible) extending between the upper and lower pulley modules. The lower pulley module 7' can include an attachment clip 8' extending distally below it and configured to receive the weight management system. Any number of components or techniques known to those skilled in the art can be used to associate the weight management system with the attachment clip. In the illustrated, non-limiting embodiment, a transportable bag 9' is coupled to the attachment clip 8' and is configured to have one or more weights, and/or weighted objects, disposed in the bag 9'. The bag 9' can have any number of sizes and shapes, depending, at least in part, on the size and configurations of the other components with which the bag is used. Similar to the container 9, the bag 9' can also be used to receive the other components of the device or system, thus allowing the system as a whole to be easily transported by storing each of the components in the bag.

In both the embodiment illustrated in FIGS. 1-9 and the embodiment illustrated in FIG. 16, a rope 6, 6' can extend between the upper and lower pulley modules 1, 7 and l', 7', and further, can extend from the upper pulley module 1 towards a user interfacing system as shown and described herein. The rope 6, 6' can move between the pulleys 15, 15' in use as understandable from the present disclosures. Although in the illustrated embodiments a single rope 6, 6' is used in conjunction with the two pulley modules 1, 7 and l', 7' and the user interfacing system, a person skilled in the art will recognize a variety of other configurations that can be incorporated between the various systems that use more than one rope, and/or other components in addition to or in lieu of pulleys without departing from the spirit of the present disclosure. A length of the rope 6, 6' can depend, at least in part, on the size and shape of the other components associated therewith, the size of the pool in which the system will be used, the size of the user, and the desired use of the device or system, e.g., the type of training being performed. In some exemplary embodiments, a length of the rope is approximately in the range of about 10 yards to about 50 yards, and in one exemplary embodiment it has a length of about 30 yards. In some exemplary embodiments, a length of about 30 yards can allow for travel across a length of a 25 yard or 25 meter pool having typical pool depths.

Figure 17:
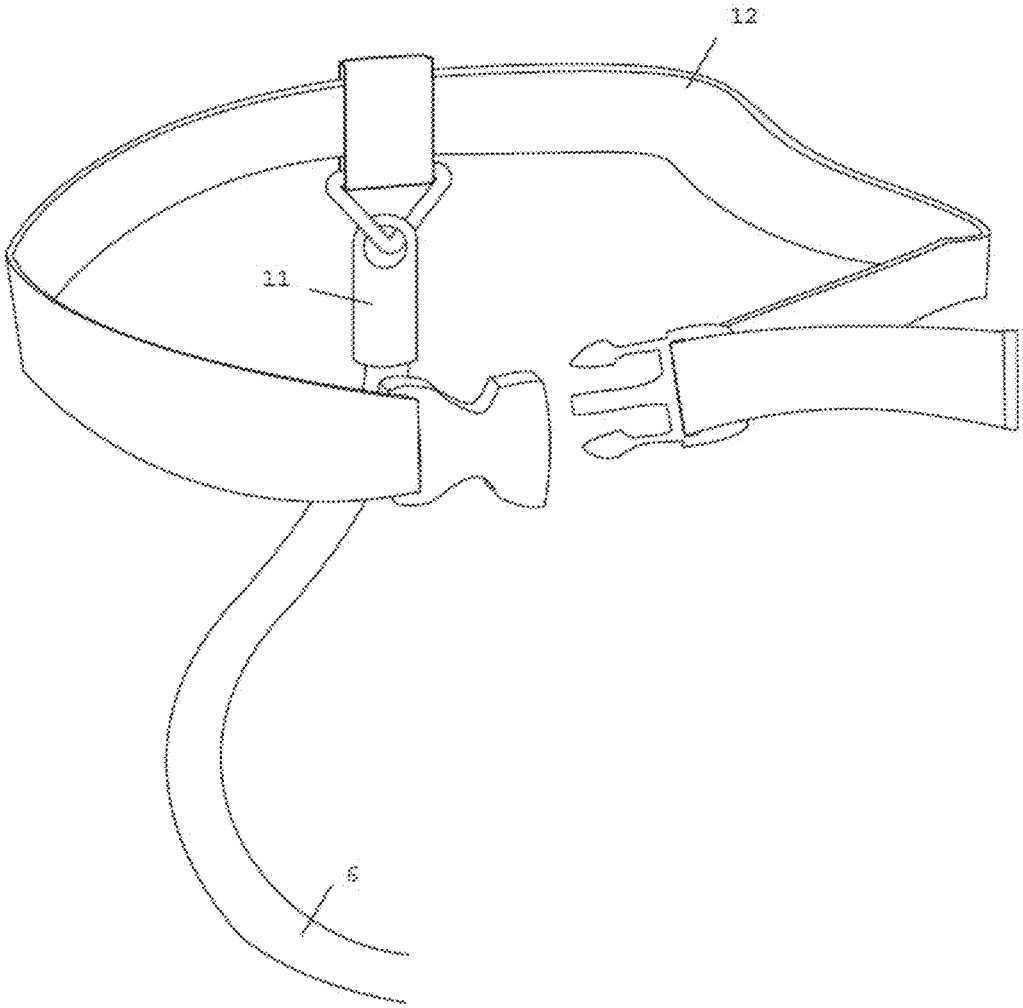
FIG. 17 is a perspective view of the user interfacing system of FIG. 1.

The portion of the rope 6 extending out of the upper pulley module, away from the lower pulley module, and toward a user can be associated with a user interfacing system. The user interfacing system can include a belt 12 configured to be attached to a user and a belt attachment component 11 configured to couple the rope to the belt 12. The belt 12, shown in FIG. 17, can be sized and configured to be coupled to a user in a variety of ways. In the illustrated embodiment, it is configured to be strapped approximately around a user's torso. In other embodiments it can be configured to wrap around a user's leg, arm, or other portion of the body to provide desired resistance training. Alternatively, it can be configured to be held be the user. The belt 12 can be adjustable to fit around different portions of a user's body, or to fit around different sized users. The attachment component 11 can be any component configured to couple one component to another. In the illustrated embodiment the attachment component 11 includes a strap and triangularly-shaped anchor that is coupled to a coupling component having a bore disposed therein and located at a proximal end of the rope 6. Many other configurations are possible. The sizes and materials used to form each of the belt 12 and the belt attachment component 11 are known to those skilled in the art based on the descriptions and illustrations provided for herein. By way of non-limiting example, the belt can be formed from a nylon webbing and/or a Velcro® belt or strap.

The user interface illustrated in FIG. 16 is shown as a belt 12' without any readily visible adjustment features, but a person skilled in the art will understand how various adjustment features can be incorporated into the belt. In some embodiments, the belt 12' can be elastic in nature such that it automatically conforms to the shape of the user around which the belt is disposed. While the belt 12' can be associated with the rope 6' using a number of different techniques and components, in the illustrated embodiment a belt attachment component 11', as shown a ring, couples the belt 12' to the rope 6'.

In use, a user can place the desired amount of weights in the weighted container 9, 9' to provide a desired resistance. The length of the adjustment strap 5 can be adjusted to a desired length, and can be secured to a sturdy point or substantially fixed location, such as the dive block 100. The upper pulley module, lower pulley module, and weighted container can be placed in a swimming pool. The user can attach the belt 12 to his or her torso (or other portion of the body as desired) and can enter the water. As the user swims or otherwise moves away from a wall of the swimming pool adjacent to the dive block 100, the weighted container can begin to ascend towards a surface of the water of the pool. The length of the rope 6, 6' can be such that as the user approaches a full length of the pool, e.g., 25 yards, the bucket is near the surface of the water of the pool. In at least some embodiments, the weighted container does not exit the water even when the rope 6, 6' is fully extended.

The swimmer can then turn around and swim or otherwise move back towards the adjacent wall, with the bucket moving back towards its initial location, further below the surface of the water, as the user approaches the wall. This movement can be repeated as desired to achieve a desired training effect. Likewise, adjustments can be made to the system in conjunction with a desired training effect. By way of non-limiting example, weights can be added or removed from the weighted container 9, 9', or the belt 12, 12' can be attached to a different portion of the user's body. Upon completion of the use of the system, it can be disconnected from the dive block 100 and all components thereof can be stored in the weighted container 9, 9', thereby making the device convenient and portable.

One skilled in the art will appreciate further features and advantages of the invention based on disclosures provided for herein. Accordingly, the invention is not to be limited by what has been particularly shown and described. For example, to the extent some embodiments of pulley modules describe pulleys being disposed within a housing, and the housing having various features for attaching the module to other portions of the system, a person skilled in the art will understand how to attach modules that do not include such housings to the other portions of the system as desired. Similarly, in instances where a bag replaces a bucket as the weighted container, a person having skill in the art will understand how to incorporate the bag, or other components used to hold weights and/or transport the other components of the system, with the rest of the device and systems. All publications and references cited herein are expressly incorporated herein by reference in their entirety.

What is claimed is:

1. A resistance training device, comprising:

a rope having one end configured to be coupled to a user;

a pulley system having at least a portion of the rope passing therethrough, the pulley system including:

a first pulley module having one or more pulleys associated therewith; and a second pulley module having one or more pulleys associated therewith, and the rope extending between the one or more pulleys of the first pulley module and one or more pulleys of the second pulley module, wherein the rope extends from the first pulley module, away from the second pulley module, to be coupled to a user;

a weight management system coupled to the second pulley module of the pulley system, the weight management system being configured to provide resistance to a user coupled to the one end of the rope and being configured to allow its weight to be adjusted to change the resistance provided by the device; and an attachment strap that suspends the pulley system therefrom and is configured to attach the pulley system to a substantially fixed location, wherein the pulley system is configured such that a distance between the first pulley module and the second pulley module changes as the rope moves with respect to the first pulley module, and wherein the weight management system further comprises a transport bag configured to receive the pulley system, the rope, and the attachment system to provide for portability of the entire resistance training device.

2. The device of claim 1, wherein the weight management system is configured to be disposed under water in use.

3. The device of claim 1, wherein the rope is configured to extend away from the pulley system as a user moves away from the weight management system.

4. The device of claim 1, wherein the weight management system is configured to receive one or more weights of a pre-determined weight to change the resistance provided by the device.

5. A resistance training device, comprising:

an attachment mechanism for attaching the device to a substantially fixed location located above the attachment mechanism such that the attachment mechanism extends distally from the substantially fixed location when attached thereto;

a plurality of pulleys having a rope associated therewith, the plurality of pulleys including at least a first pulley located higher than a second pulley, and the plurality of pulleys being configured to extend distally below the attachment mechanism when the attachment mechanism is attached to the substantially fixed location; and a weighted component associated with the second pulley of the plurality of pulleys and configured to extend distally below the plurality of pulleys when the attachment mechanism is attached to the substantially fixed location to provide a resistance to an end of a rope disposed on the other side of the plurality of pulleys, wherein, the plurality of pulleys and rope associated therewith is configured such that a distance between the first pulley module and the second pulley module changes as the rope moves with respect to the first pulley module.

6. The device of claim 5, wherein the first pulley is part of a first set of pulleys and the second pulley is part of a second set of pulleys, with the first set of pulleys being located closer to the attachment mechanism than the second set of pulleys is located, and the second set of pulleys being located closer to the weighted component than the first set of pulleys is located.

7. The device of claim 5, wherein the weighted component is configured to be disposed under water in use.

8. The device of claim 5, wherein the rope is configured to extend away from the plurality of pulleys as a user moves away from the weighted component.

9. The device of claim 5, the weighted component further comprises a transport bag configured to receive the attachment mechanism and the plurality of pulleys having a rope associated therewith to provide for portability of the entire resistance training device.

10. The device of claim 9, wherein the weighted component is configured to allow weight to be adjusted to change the resistance provided by the device by adding and removing weight from the transport bag.

11. The device of claim 5, wherein the weighted component is configured to allow its weight to be adjusted to change the resistance provided by the device.

12. The device of claim 5, wherein the attachment mechanism is configured to be adjustable to change a distance extending between the substantially fixed location and one or more pulleys of the plurality of pulleys when the attachment mechanism is attached to the substantially fixed location.

13. The device of claim 5, wherein the attachment mechanism comprises an attachment strap.

14. A method for providing resistance while swimming, comprising:

attaching a resistance training device comprising a first pulley module having at least one pulley and a second pulley module having at least one pulley with a rope disposed between the at least one pulley of the first pulley module and the at least one pulley of the second pulley module to a substantially sturdy point proximate to a swimming pool such that a weighted component of the resistance training device is disposed below the surface of the water; and attaching the resistance training device to a user by way of the rope such that as the user swims away from the substantially sturdy point, the second pulley module and the weighted component moves towards the surface of the water and the rope travels with respect to the at least one pulley of the first pulley module and the at least one pulley of the second pulley module, wherein the resistance training device is configured to hang from the substantially sturdy point such that the first pulley module, the second pulley module, and the weighted component are disposed below the substantially sturdy point, and wherein a distance between the first pulley module and the second pulley module changes as the rope moves with respect to the first pulley module.

15. The method of claim 14, further comprising storing all other components of the resistance training device in the weighted component to transport the device.

16. The method of claim 14, further comprising adjusting a weight in the weighted component to change the amount of resistance provided to the user.

17. The method of claim 14, wherein the substantially sturdy point is a dive block.

18. The method of claim 14, wherein attaching a resistance training device comprising a first pulley module and a second pulley module to a substantially sturdy point proximate to a swimming pool further comprises doing so such that the first pulley module is disposed at or below the surface of the water and the second pulley module is disposed below the surface of the water.

19. The method of claim 14, further comprising adjusting a location of the first pulley module with respect to the substantially sturdy location by adjusting a length of an attachment strap associated with the first pulley module.

20. A method for providing resistance while swimming, comprising:

attaching a resistance training device comprising a first pulley module having at least one pulley and a second pulley module having at least one pulley with a rope disposed between the at least one pulley of the first pulley module and the at least one pulley of the second pulley module to a substantially sturdy point proximate to a swimming pool such that the first pulley module is disposed at or below the surface of the water, and each of the second pulley module and a weighted component of the resistance training device is disposed below the surface of the water; and attaching the resistance training device to a user by way of the rope such that as the user swims away from the substantially sturdy point, the second pulley module and the weighted component moves towards the surface of the water and the rope travels with respect to the at least one pulley of the first pulley module and the at least one pulley of the second pulley module, wherein the resistance training device is configured to hang from the substantially sturdy point such that the first pulley module, the second pulley module, and the weighted component are disposed below the substantially sturdy point, and wherein a distance between the first pulley module and the second pulley module changes as the rope moves with respect to the first pulley module.

21. The method of claim 20, further comprising storing all other components of the resistance training device in the weighted component to transport the device.

22. The method of claim 20, further comprising adjusting a weight in the weighted component to change the amount of resistance provided to the user.

23. The method of claim 20, wherein the substantially sturdy point is a dive block.

24. The method of claim 20, further comprising adjusting a location of the first pulley module with respect to the substantially sturdy location by adjusting a length of an attachment strap associated with the first pulley module.

* * * * *